United States Patent [19]

Mayer

[11] Patent Number: 5,001,908

[45] Date of Patent: Mar. 26, 1991

[54] OIL SEPARATOR FOR REFRIGERATION APPARATUS

[75] Inventor: Donald K. Mayer, Bloomington, Minn.

[73] Assignee: Thermo King Corporation, Minneapolis, Minn.

[21] Appl. No.: 484,141

[22] Filed: Feb. 23, 1990

[51] Int. Cl.[5] ..... F25B 43/02

[52] U.S. Cl. ..... 62/470; 62/84; 62/193

[58] Field of Search ..... 62/470, 193, 468, 84; 210/168; 55/421, 423, 459 R, 323, 482, 321

[56] References Cited

U.S. PATENT DOCUMENTS

| | | | |
|---|---|---|---|
| 2,608,269 | 8/1952 | Briggs | 62/470 X |
| 2,846,138 | 8/1958 | Racklyeft | 62/470 X |
| 2,875,592 | 3/1959 | Olsen | 62/470 X |
| 3,408,828 | 11/1968 | Soumerai et al. | 62/470 |
| 3,850,009 | 11/1974 | Villadsen | 62/470 X |
| 4,419,865 | 12/1983 | Szymaszek | 62/193 |
| 4,506,523 | 3/1985 | DiCarlo et al. | 62/470 |
| 4,788,825 | 12/1988 | Colupca et al. | 62/84 |

*Primary Examiner*—Lloyd L. King
*Attorney, Agent, or Firm*—D. R. Lackey

[57] ABSTRACT

An oil separator suitable for separating oil from vaporized refrigerant leaving the high pressure discharge side of a refrigerant compressor, and for returning the separated oil to the compressor crankcase. The oil separator includes an elongated housing having a longitudinal axis. Oil separation stages and a capillary tube are disposed within the housing. The capillary tube has a first end into which oil may flow, and a second end in fluid flow communication with an oil return outlet on the housing. The first end of the capillary tube and the oil return outlet are positioned relative to one another such that the longitudinal axis of the housing may be oriented at any selected angle in a range of ninety degrees between horizontal and vertical orientations. The capillary tube has a bore and length selected such that a predetermined refrigerant flow rate is created which carries oil to the crankcase.

9 Claims, 4 Drawing Sheets

EVAPORATOR
CONDENSER
10
12
14
16
18
20
22
24
26
28
30
32
34
35
36
37
38
39
40
41

EVAPORATOR
CONDENSER
10
12
14
16
18
20
22
24
26
28
30
32
34
35
36
37
38
39
40
41

EVAPORATOR
CONDENSER
10
12
14
16
18
20
22
24
26
28
30
32
34
35
36
37
38
39
41
44

OIL SEPARATOR FOR REFRIGERATION APPARATUS

TECHNICAL FIELD

The invention relates in general to oil separators, and more specifically to oil separators suitable for removing oil from vaporized high pressure refrigerant being discharged from a refrigerant compressor, and returning the oil to a low pressure oil sump in the compressor crankcase.

BACKGROUND ART

Oil separators are used in refrigeration systems to remove the compressor lubricating oil aerosol from the hot, high pressure compressor discharge refrigerant vapor, e.g., R-12, R-22, R-502, and to return this oil to the compressor oil sump, which is essentially at suction pressure. This function benefits the compressor during periods of marginal lubrication. This function also improves the cooling effectiveness of the entire refrigeration system, as this oil/refrigerant aerosol would normally penalize the refrigeration system by diminished heat transfer through the condenser and evaporator coils, and by reduced compressor volumetric efficiency from diminished refrigerant mass flow rate. The oil separator prevents these functional problems by intercepting this compressor oil before it can circulate through the refrigeration system, and returning it directly back to the oil sump.

There are two general classes of refrigeration oil separators, classified by their different methods of pressure reduction, whereby oil removed from the high pressure side of the compressor is returned to the low pressure oil sump. One type uses a ball-float valve to meter oil flow from an oil separator reservoir. This type of oil separator is vulnerable to mechanical vibration and shock, and is thus more appropriate for static or fixed refrigeration systems. The other class of oil separators uses a restrictive orifice, such as a capillary tube, to return the oil to the low pressure sump. This type is not affected by vibration and shock, and may be used in transport refrigeration systems, for example.

Oil separators for smaller capacity refrigeration systems, such as transport refrigeration systems used for cooling the cargoes of trucks, trailers, and containers, are relatively costly, they have marginal performance effectiveness, and they require vertical axis installation. The orientation limitation is due to the fact that the capillary oil-return tube depends upon gravity to return the separated oil. The vertical axis orientation limitation can present awkward installation difficulties, particularly in many truck refrigeration applications with very confined access space.

Thus, it would be desirable and it is an object of the invention to provide a new and improved oil separator suitable for high vibration and shock environments, which is relatively inexpensive, is highly effective without excessive pressure drop, and which does not require vertical axis mounting.

SUMMARY OF THE INVENTION

Briefly, the present invention is a new and improved oil separator suitable for use in refrigeration systems which operate in environments where shock and vibration are present, such as in transport refrigeration systems. The oil separator includes an elongated housing defining an enclosed space having first and second axial ends, and a longitudinal axis which extends between the ends. A refrigerant inlet and a refrigerant outlet are disposed at the first and second axial ends, respectively, and an oil return outlet is disposed at the second end, radially spaced from the longitudinal axis by a first predetermined dimension.

In a preferred embodiment of the invention, oil is removed from the incoming refrigerant vapor in two successive stages, a centrifugal stage and a coalescing filter stage. The oil collects within the housing via gravity.

A capillary tube having first and second ends is disposed within the enclosed space. The second end of the capillary tube is in fluid flow communication with the oil return outlet. The first end of the capillary tube is also disposed at the second axial end of the enclosed space. The first end is radially spaced from the longitudinal axis in substantially the same direction as the oil return outlet, with the radial spacing exceeding the first predetermined dimension. This location of the first end of the capillary tube places it in fluid flow relation with the gravity fed supply of collecting oil when the longitudinal axis of the housing is substantially horizontal and the housing is oriented about its axis such that the first end of the capillary tube is vertically below the oil return outlet.

The first end of the capillary tube will remain in fluid flow communication with the gravity fed supply of separated oil when the longitudinal axis of the housing is vertically oriented, and also at any selected angle between the horizontal orientation and the vertical orientation, as long as the first end of the capillary tube is below the oil return outlet.

The length and bore of the capillary tube are selected to provide a predetermined refrigerant flow rate from the first end to the second end, providing the motive force for returning oil removed from the refrigerant back to the compressor oil sump. The refrigerant flow rate through the capillary tube is selected to be a very small portion of the total refrigerant flow rate through the oil separator, and it thus has little affect on the refrigeration capacity of the associated refrigeration system.

BRIEF DESCRIPTION OF THE DRAWINGS

The invention will become more apparent by reading the following detailed description in conjunction with the drawings which are shown by way of example only, wherein.

DESCRIPTION OF PREFERRED EMBODIMENTS

Figure 1:
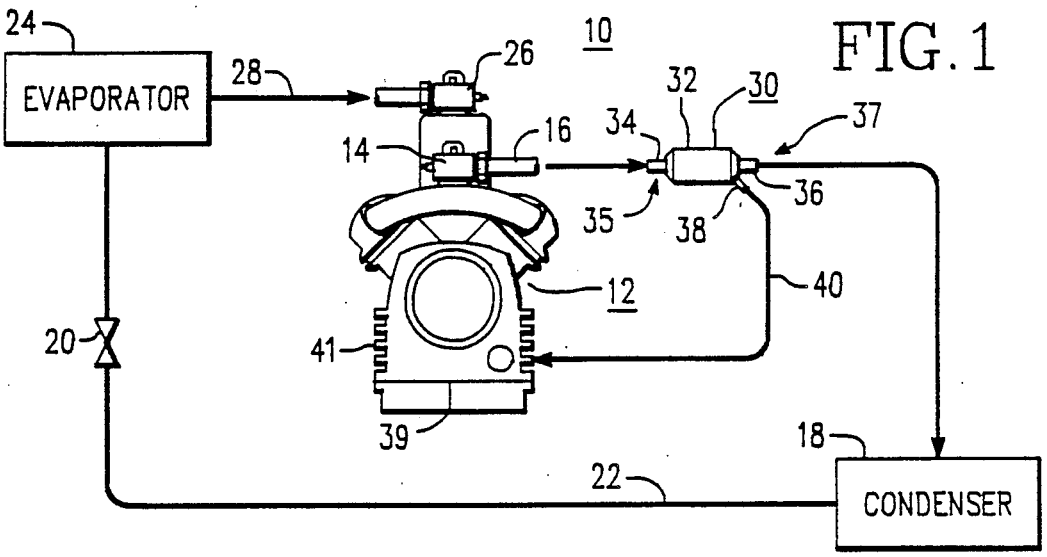
FIG. 1 is a partially schematic and partially diagrammatic representation of a refrigeration system showing horizontal mounting of an oil separator constructed according to the teachings of the invention.
Figure 2:
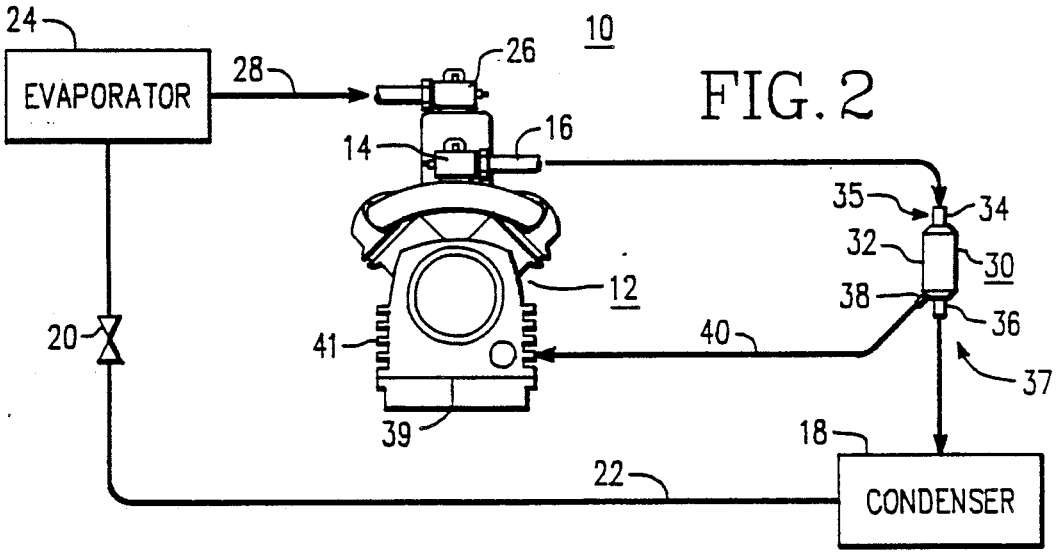
FIG. 2 is similar to FIG. 1, except showing the oil separator of the invention vertically mounted.
Figure 3:
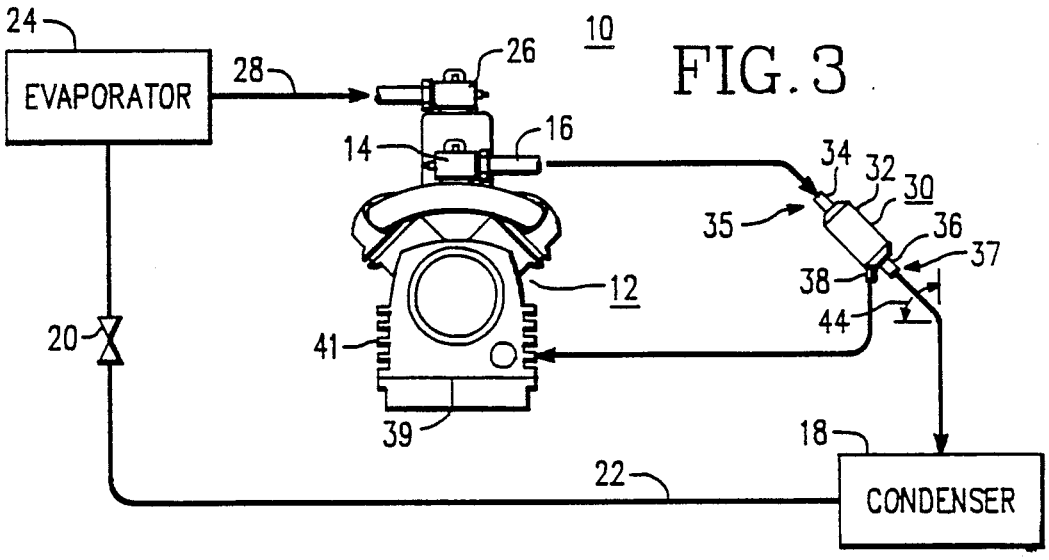
FIG. 3 is similar to FIG. 1, except illustrating that the oil separator may be mounted at any selected angle between the horizontal and vertical mounting orientations of FIGS. 1 and 2.

Referring now to the drawings, and to FIGS. 1, 2 and 3 in particular, there is shown a refrigeration system 10, such as a transport refrigeration system, or any other type of refrigeration system which may operate in an environment which includes shock and vibration. Refrigeration system 10 includes a refrigerant compressor 12 which discharges hot, high pressure refrigerant vapor from a discharge port and service valve 14 to a hot gas line 16. A condenser 18 removes heat from the refrigerant, condenses it to a high pressure liquid, and supplies the refrigerant to an expansion valve 20 via a liquid line 22. The resulting lower pressure liquid refrigerant is vaporized in an evaporator 24, removing heat from air surrounding the evaporator coil, and the vaporized refrigerant is returned to a suction port and service valve 26 via a suction line 28.

An oil separator 30 constructed according to the teachings of the invention is disposed in the hot gas line 16. Oil separator 30 includes an elongated housing 32 having a refrigerant inlet 34 at a first axial end 35 which receives refrigerant vapor and entrained lubricating oil aerosol from the compressor 12, and a refrigerant outlet 36 at the remaining or second axial end 37 which discharges refrigerant vapor minus the oil aerosol for continued travel through the refrigeration system 10. An oil return outlet 38 returns separated lubricating oil to an oil sump 39 in the crankcase 41 of compressor 12 via an oil return line 40.

Figure 4:
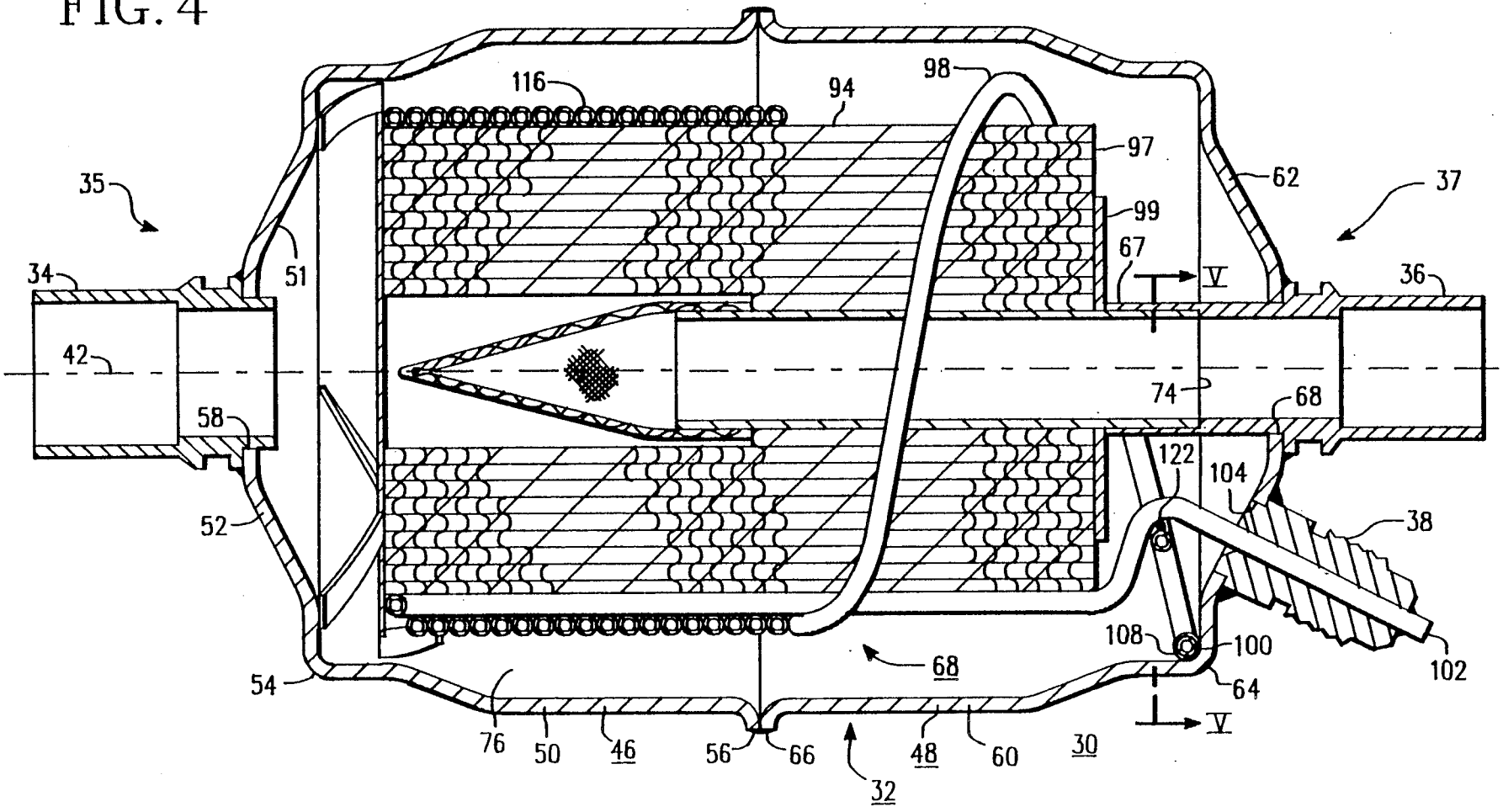
FIG. 4 is a cross sectional view of the oil separator shown in FIGS. 1, 2 and 3, illustrating a preferred embodiment of the oil separator.

FIG. 1 illustrates that oil separator 30 may be mounted with a longitudinal axis 42, shown in FIG. 4, which extends between the first and second axial ends 35 and 37, substantially horizontally oriented. FIG. 2 illustrates that oil separator 30 may be mounted with the longitudinal axis 42 substantially vertically oriented. FIG. 3 illustrates that oil separator 30 may be mounted with longitudinal axis 42 mounted at any desired angle in a range 44 of substantially ninety degrees between the horizontal orientation of FIG. 1 and the vertical orientation of FIG. 2.

FIG. 4 is a cross sectional view of oil separator 30, illustrating a preferred embodiment of the invention. Housing 32 is preferably formed of first and second similar metallic shells 46 and 48, such as 15 gage cold rolled steel, which cooperatively define a closed space 49 having first and second axial ends 51 and 53, respectively. Shell 46 includes a cylindrical tubular portion 50 which is joined near the first end 35 of the housing 32 by an end wall portion 52, which may be integral with cylindrical portion 50, to form a corner portion 54. Cylindrical portion 50 is open and outwardly flanged at the remaining end, as indicated at 56. End wall portion 52 includes a central opening 58 concentric with longitudinal axis 42 which receives the refrigerant inlet connector 34. The refrigerant inlet connector 34, which may also be formed of steel, is welded or brazed to end wall portion 52 of housing shell 46.

In like manner, shell 48 includes a cylindrical tubular portion 50 which is joined near the second end 37 of the housing 32 by an end wall portion 62, which may be integral with cylindrical portion 60, to form a corner portion 64. Cylindrical portion 60 is open and outwardly flanged at the remaining end, as indicated at 66. End wall portion 62 includes a central opening 68 concentric with longitudinal axis 42 which receives the refrigerant outlet connector 36. The refrigerant outlet connector 36, which may also be formed of steel, is welded or brazed to end wall portion 62 of housing shell 48.

Refrigerant outlet connector 36 includes an end portion 67 within the hollow space defined by the second shell 48, to which an oil separating assembly 68 is attached. For example, oil separating assembly 68 may include a hollow tubular metallic support member 70, which also functions as an outlet tube for the refrigerant after the oil has been removed therefrom. Tubular member 70, which may be formed of steel, includes first and second ends 72 and 74, respectively. The first end 72 includes a screen or filter member 73, such as a fine mesh tubular screen having one closed end, and an open end. The open end surrounds and is suitably attached to tubular member 70 adjacent to end 72 for preventing particulate matter from entering the associated refrigeration system 10 via tubular member 70. Tubular member 70 is dimensioned near its second end 74, and refrigerant outlet connector 36 is dimensioned adjacent its end 67, to form a tight telescoping press fit or brazed joint between them. The first and second shells 46 and 48 may then be joined together at their flanges 56 and 66, such as by welding.

For purposes which will become apparent as the description proceeds, the oil separating assembly 68 has a cylindrical outer form defining an outer diameter which is less than the inside diameter of cylindrical portions 50 and 60, to define an annular space 72 between the oil removing assembly 68 and the inner walls of cylindrical portions 50 and 60.

Figure 6:
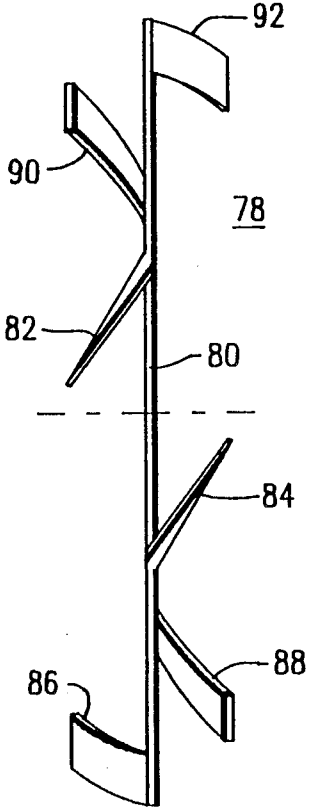
FIG. 6 is a side elevational view of an inlet louver shown in section in FIG. 4, which louver is part of a first stage of oil removal.

In a preferred embodiment of the invention, the oil separating assembly 68 includes first and second successive stages of oil removal, with the first stage including an inlet louver 78, best shown in the side elevational view of FIG. 6. Inlet louver 78 is a round, flat metallic plate, such as galvanized steel, having a plurality of evenly spaced vanes formed therein adjacent the outer periphery of the plate, which vanes are alternately bent outward from the main flat plate body portion 80 in opposite directions. For example, six vanes 82, 84, 86, 88, 90 and 92 may extend outwardly from body portion 80, with vanes 82, 86 and 90 extending outwardly in uniformly spaced circumferential relation from one side of body portion 80, and with vanes 84, 88 and 92 extending outwardly in uniformly spaced circumferential relation from the other side of body portion 80.

The inlet louver 78 is positioned within the space defined by housing 32, adjacent to the first axial end 35, such that the major flat sides thereof are perpendicular to the longitudinal axis 42. Vanes 82, 84, 86, 88, 90 and 92 are aligned with the annular space 76. The hot high pressure refrigerant vapor with entrained lubricating oil aerosol strikes the inlet louver 78 and the vanes 82, 84, 86, 88, 90 and 92 direct the refrigerant vapor into a helical vortex flow into and around the annular space 76. The centrifugal force field generated in the free vortex that results from the inlet louver's vanes causes the entrained oil droplets to migrate toward and impinge against the inside walls of the housing 32. This forms an oil film on the inside walls of housing shells 46 and 48 that flows by gravity to accumulate on the lowest portion of the inner walls defined by shells 46 and 48.

The second stage of oil separation occurs in a coalescent filter pack 94 which has a first axial end 95 which starts at and is in contact with the inlet louver 78, a second axial end 97 which is positioned by a large metallic washer member 99, and a central opening 101. The second axial end 97 is in spaced relation relative to the end wall 62 at the second axial end 37 of the housing 32. The coalescent filter pack 94 receives the refrigerant vapor after the initial centrifugal oil separation has occurred, and the partially "cleaned" stream of refrigerant then flows back through the filter pack 94, where it enters the screened end 72 of outlet tube and support member 70. The screened end 72 is axially spaced from the inlet louver 78 to provide a refrigerant entry space 96. The screen 73 on the first end 72 of outlet tube and support 70 prevents any fragments from the filter pack 94, or similar debris, from leaving the oil separator outlet 36 and contaminating the refrigeration system 10.

The residual oil aerosol still in the refrigerant as the refrigerant enters filter pack 94 coalesces on the strands of the filter pack 94. In a preferred embodiment of the filter pack 94, it is in the form of a porous cylindrical pack of knitted wire mesh, such as .005 inch diameter galvanized steel wire. A flattened and crimped "stocking" of such knitted wire mesh is coiled into a resilient spool or cylinder about the tubular support and outlet member 70. While galvanized wire is preferred in an environment of mechanical shock and vibration, other alternative materials for the filter pack 94 include spun fiberglass and expanded open-cell foam. The filter pack 94 functions by intercepting the microscopic oil mist particles in the gas stream, which causes the oil to coalesce or agglomerate into larger drops which migrate by gravity along the wire strands to the bottom of the pack, where the oil falls by gravity to the interior bottom of housing 32. The drops of oil become too large to become re-entrained in the stream of refrigerant vapor as the coalesced drops of oil migrate through the pack and fall to the bottom of the enclosed space.

Before assembly, the axial length of the coalescent filter pack 94 is somewhat longer than the available assembled distance between the flat surface of body portion 80 of louver 78 and the metal support disc 99 which is concentric with outlet tube 70 and axially positioned by refrigerant outlet 36 at its end 67. The axial compression resilience of the coalescent filter pack 94 which extends axially somewhat beyond the first axial end 118 of capillary coil 116 before assembling, provides a spring-like pressure which causes the coalescent filter pack 94 to bear against the inlet louver 78 and hold louver 78 against axial end 52 of shell 46. This is the desired assembled position of louver 78, and it automatically assumes this desired position when shells 46 and 48 are pressed and welded together at flanges 56 and 66.

The refrigerant vapor may be prevented from entering the filter pack 94 too soon by enclosing the filter pack for at least about one-half of its axial length, starting at its first axial end 95 adjacent to the inlet louver 78, to shield inlet space 96 and prevent a "short-circuiting" of the refrigerant vapor through the end of the filter pack 94 which directly surrounds space 96. This enclosure about the first axial end of the filter pack may take the form of a thin walled tubular metallic skirt formed of any suitable material, such as aluminum or steel, but in a preferred embodiment of the invention, the shielding effect is provided by the configuration of a capillary tube 98 which provides an oil pick-up and return function, eliminating the need for a separate shielding skirt.

The refrigerant vapor, with the major portion of the compressor lubricating oil removed, thus enters the screened end 72 of the output tube 70, where it continues to the condenser 18. The refrigerant vapor within oil separator 30 is at the relatively high discharge compressor pressure, and the accumulated oil on the "bottom" of the housing 32 must flow from this relatively high pressure region to the compressor oil sump, which is essentially at compressor suction pressure. This pressure reduction is accomplished in the oil return circuit by the hereinbefore mentioned capillary tube 98.

The bore diameter and length of the capillary tube 98 are selected to provide a flow of compressor discharge vapor back to the compressor oil sump at a very low rate, such as approximately one to five percent of the total compressor flow. This flow of refrigerant vapor serves as the vehicle to carry the separated oil back to the compressor, without a significant reduction or waste of compressor capacity. An annealed copper tube having an outside diameter of .094 inch, an inside diameter of .049 inch, and a length of about 142 inches has been found to be suitable, but other materials, lengths and bore diameters may be used.

Figure 5:
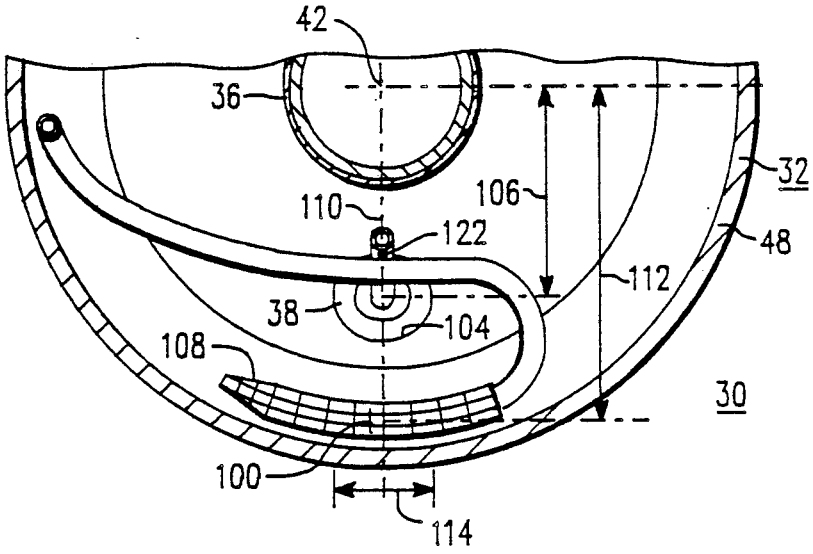
FIG. 5 is a cross sectional view of the oil separator shown in FIG. 4, taken between and in the direction of arrows V—V in FIG. 4.

The capillary tube 98 has first and second ends 100 and 102, respectively, with the first end being located at the corner 64 between tubular portion 60 and end wall 62, and with the second end being in fluid flow communication with or through the oil return outlet 38. The oil return outlet 38 is mounted in an opening 104 formed in end wall 62, which opening is radially spaced from the longitudinal axis 42 by a first dimension 106, best shown in FIG. 5, which is a cross-sectional view of oil separator 30 taken between arrows V—V in FIG. 4. The first end 100 of capillary tube 98 is surrounded by a strainer, screen or filter member 108, best shown in FIG. 5, and, as also shown in FIG. 5, end 100 is radially spaced from the longitudinal axis 42 in the same direction as opening 104 and by a second dimension 112 which exceeds the first dimension 106. End 100 thus lies substantially on a plane 110 which is common with longitudinal axis 42 and the center of opening 104. The dimension 114 in FIG. 5 indicates that end 100 may lie anywhere within this dimension relative to plane 110, which is approximately .5 inch on either side of plane 110. The strainer 108 may be fine-mesh tubular screen which is fastened to the capillary inlet end 100 to prevent stray particulate matter from possibly plugging the small bore of the capillary tube 98. An equivalent strainer function may also be provided with a sintered pressed powdered metal filter, or the like.

Figure 7:
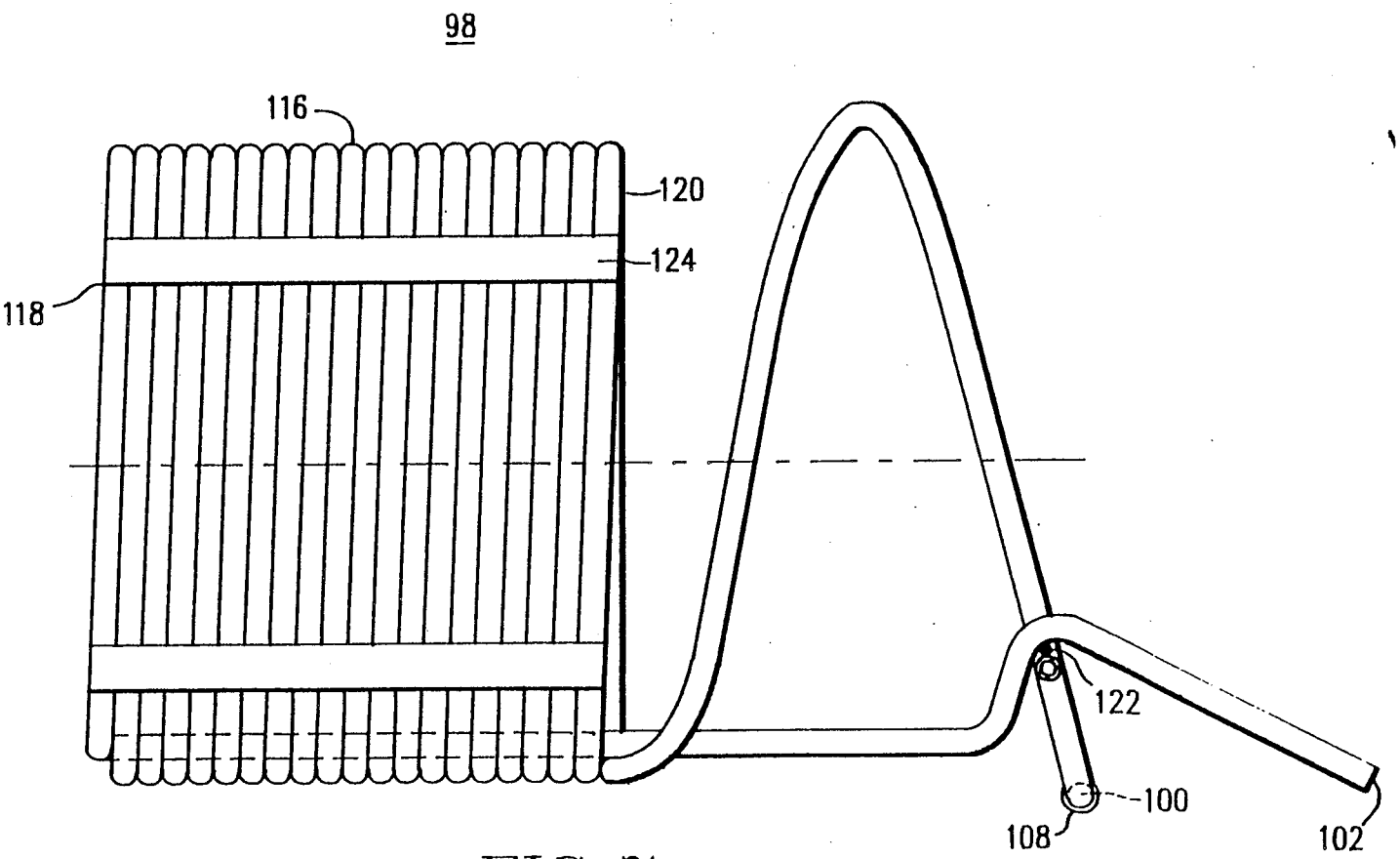
FIG. 7 is a side elevational view of a capillary tube shown in section in FIG. 4, which returns a gravity fed supply of lubricating oil removed from refrigerant vapor to the oil sump of an associated refrigerant compressor.

Between the first and second ends 100 and 102, as shown in FIGS. 4 and 7, capillary tube 98 is rolled into a closely spaced cylindrical coil 116 having first and second axial ends 118 and 120, respectively. A plurality of axially disposed, circumferentially spaced solder beads 124 hold the closely spaced turns of cylindrical coil 116 together to form a rigid cylinder. Coil 116 has an inside diameter which is slightly smaller than the outside diameter of the filter pack 94, providing additional compression of the resilient filter pack 94. The axial length of the cylindrical coil 116 is at least equal to about one-half of the axial length of filter pack 94, with the first axial end 118 starting at the inlet louver 78 to form a shield about the space 96 adjacent the entry end 72 of the tubular outlet tube 70. Thus, refrigerant vapor entering the annular space 76 is forced to flow towards the second axial end 97 of the filter pack 94, ensuring a substantially uniform flow of refrigerant vapor through the entire filter pack 94, instead of being concentrated heavily at the first axial end 95.

The strategic positioning of the oil entry end 100 of the capillary tube at the corner 64 of the housing 32 where the housing 32 changes from a cylindrical configuration defined by wall portion 60 to enter end wall 62, may be ensured by tack soldering two portions of the capillary tube 98 together, as indicated at 122, at a location close to both ends 100 and 102 of the capillary tube 98. Since end 102 is fixed to outlet 38, such as by extending completely through outlet 38, as illustrated, soldering two portions of capillary tube 98 together adjacent to their ends 100 and 102 will fix the location of the first end 100 and its associated filter 108. This eliminates the need for a separate clip to hold the desired position of end 100.

The relative locations of the oil entry end 100 of the capillary tube 98, plus the orienting of the inlet end 100 in substantially the same plane 110 as the longitudinal axis 42 and the center of opening 104, enables the capillary tube inlet 100 to "see" the gravity fed supply of collected compressor lubricating oil with a horizontal orientation of longitudinal axis 42, with a vertical orientation, and with any angle therebetween.

When the axis 42 is vertically oriented, it does not make any difference how the oil separator 30 is circumferentially oriented about axis 42. When axis 42 is horizontally oriented, the oil separator should be circumferentially oriented such that end 100 is at the very bottom of housing 32. As the angle of orientation is raised from horizontal towards the vertical, end 100 should retain this "bottom" position. In other words, when viewing end 100 in FIG. 4, end 100 may be thought of as a pivot axis, with the oil separator 30 being pivoted clockwise about this pivot axis, to reach the desired angle between horizontal and vertical. This orientation flexibility of oil separator 30 is particularly advantageous when used with refrigeration systems having cramped mounting locations, such as in the engine compartment under the hood of certain vehicles.

I claim:

1. An oil separator, suitable for fluid flow communication with the high pressure discharge side of a refrigerant compressor having an oil sump which operates at suction pressure, for separating oil from high pressure refrigerant and returning it to the lower pressure oil sump, comprising:

an elongated housing defining an enclosed space having first and second axial ends, a longitudinal axis which extends between said first and second axial ends, a refrigerant inlet at said first axial end, and a refrigerant outlet at said second axial end, an oil return outlet at the second axial end, spaced radially outward from the longitudinal axis by a first predetermined dimension, means in said enclosed space for separating oil from the refrigerant, such that said separated oil accumulates by gravity within the enclosed space, a capillary tube in the enclosed space having first and second ends, the first end of said capillary tube being disposed at the second axial end of the enclosed space, spaced radially outward from the longitudinal axis by a second predetermined dimension which is greater than said first predetermined dimension, and in substantially the same direction from the longitudinal axis as the oil return outlet, such that the first end of the capillary tube lies in a plane common with the longitudinal axis and the oil return outlet, the second end of said capillary tube being in fluid flow communication with said oil return outlet, said capillary tube having a bore and length selected to provide a predetermined refrigerant flow rate through the capillary tube, from the first to the second end thereof, when the refrigerant inlet is connected to receive high pressure refrigerant, and the oil return outlet is connected to the oil sump, with said predetermined flow rate carrying oil adjacent to the first end of said capillary tube back to the oil sump, whereby the first end of the capillary tube may be maintained at substantially the lowest point of the enclosed space when the housing is mounted with said longitudinal axis at any selected angle in a substantially ninety degree range between horizontal and vertical.

2. The oil separator of claim 1 wherein the means in the enclosed space for separating oil from refrigerant includes successive first and second stages of oil separation, with the second stage creating an annular space between the housing and second stage, and with the first stage including means for directing refrigerant entering the enclosed space into a helical vortex flow around the annular space.

3. The oil separator of claim 2 wherein the second stage includes a coalescing filter.

4. The oil separator of claim 1 wherein the means in the enclosed space for separating oil from refrigerant includes successive first and second stages of oil separation, with the second stage including a coalescing filter having first and second axial ends near the first and second axial ends of the enclosed space, respectively, and a central opening which extends between said first and second axial ends, said coalescing filter being dimensioned to create an annular space between the housing and filter, said first stage including means for directing refrigerant entering the enclosed space into a helical vortex flow around the annular space, and including refrigerant flow directing means for causing the refrigerant to flow through the coalescing filter from the second axial end towards the first axial end.

5. The oil separator of claim 4 wherein the flow directing means includes a tubular member disposed within the central opening of the coalescing filter such that entry to the tubular member may be gained only near the first axial end of the coalescing filter, and wherein the capillary tube includes a portion in the form of a cylindrical coil having closely spaced turns disposed about the coalescent filter, with said cylindrical coil portion being disposed to cause refrigerant to enter the coalescing filter near the second axial end of the filter.

6. The oil separator of claim 5 wherein the tubular member disposed within the central opening of the coalescing filter has first and second axial ends, and including a screen member attached to the first axial end to prevent particulate matter from entering the tubular member, and with the second axial end being in fluid flow communication with the refrigerant outlet.

7. The oil separator of claim 1 including a screen member disposed to prevent particulate matter from entering the first end of the capillary tube.

8. The oil separator of claim 1 wherein the second end of the capillary tube is fixed to the oil return outlet, and including means fixing a predetermined location of the capillary tube near the first end thereof to a predetermined location of the capillary tube near the oil return outlet.

9. The oil separator of claim 1 wherein the means in the enclosed space for separating oil from refrigerant includes successive first and second stages of oil separation, with the first stage being a louver member which directs refrigerant entering the enclosed space via the refrigerant inlet into a helical vortex flow, and the second stage includes a resilient, compressed coalescing filter pack, with the compressed filter pack providing a spring pressure against said louver member which holds the louver member in a desired assembled position relative to the first axial end of the enclosed space.

* * * * *